US009397379B2

(12) United States Patent
Kroening

(10) Patent No.: US 9,397,379 B2
(45) Date of Patent: Jul. 19, 2016

(54) MULTI-JUNCTION WAVEGUIDE CIRCULATORS WITH SHARED DISCONTINUOUS TRANSFORMERS

(71) Applicant: Honeywell International Inc., Morristown, NJ (US)

(72) Inventor: Adam M. Kroening, Atlanta, GA (US)

(73) Assignee: Honeywell International Inc., Morris Plains, NJ (US)

( * ) Notice: Subject to any disclaimer, the term of this patent is extended or adjusted under 35 U.S.C. 154(b) by 20 days.

(21) Appl. No.: 14/575,314

(22) Filed: Dec. 18, 2014

(65) Prior Publication Data

US 2016/0181680 A1 Jun. 23, 2016

(51) Int. Cl.
*H01P 1/39* (2006.01)

(52) U.S. Cl.
CPC ..... *H01P 1/39* (2013.01)

(58) Field of Classification Search
CPC ..... H01P 1/39; H01P 1/383
USPC ..... 333/1.1, 24.2
See application file for complete search history.

(56) References Cited

U.S. PATENT DOCUMENTS

| | | | |
|---|---|---|---|
| 3,582,831 | A | 6/1971 | Siekanowicz |
| 4,697,158 | A | 9/1987 | Hoover et al. |
| 6,885,257 | B2 | 4/2005 | Kroening |
| 7,049,900 | B2 | 5/2006 | Kroening |
| 7,176,767 | B2 | 2/2007 | Kroening |
| 7,230,507 | B2 | 6/2007 | Kroening |
| 7,561,003 | B2 | 7/2009 | Kroening |
| 2005/0030117 | A1 | 2/2005 | Kroening |
| 2009/0108953 | A1 | 4/2009 | Kroening |
| 2014/0049332 | A1 | 2/2014 | Kroening |
| 2014/0049334 | A1 | 2/2014 | Kroening |
| 2014/0320227 | A1 | 10/2014 | Kroening et al. |

OTHER PUBLICATIONS

Forney, "Matrix Ferrite Driver Circuit", U.S. Appl. No. 14/068,515, filed Oct. 31, 2013, pp. 1-26.

Kroening et al., "Multi-Junction Waveguide Circulator Using Dual Control Wires for Multiple Ferrite Elements", U.S. Appl. No. 14/460,723, filed Aug. 15, 2014, pp. 1-33.

European Patent Office, "Extended European Search Report from EP Application No. 15199438.1 mailed May 24, 2016", from Foreing Counterpart of U.S Appl. No. 14/573,314, May 24, 2016, pp. 1-8, Published in: EP.

*Primary Examiner* — Stephen E Jones
(74) *Attorney, Agent, or Firm* — Fogg & Powers LLC

(57) ABSTRACT

A multi-junction circulator assembly comprises a waveguide housing including first and second sets of waveguide arms, and a junction section therebetween. A first circulator component located in the waveguide housing comprises a ferrite element including a plurality of leg segments, with one of the leg segments extending toward the junction section. A second circulator component located in the waveguide housing operatively communicates with the first circulator component and comprises a ferrite element including a plurality of leg segments, with one of the leg segments extending toward the junction section. A dielectric transition segment is located in the junction section between the leg segments of the ferrite elements that extend toward the junction section. The dielectric transition segment is separated from the leg segments by opposing gaps at opposite ends of the dielectric transition segment. The gaps provide dielectric-free regions in the direction of signal flow between the ferrite elements.

20 Claims, 4 Drawing Sheets

MULTI-JUNCTION WAVEGUIDE CIRCULATORS WITH SHARED DISCONTINUOUS TRANSFORMERS

BACKGROUND

Common waveguide circulators have metal waveguide arms that meet in a common junction region having a ferrite element. Dielectric transformers are employed in the circulators to provide an impedance match between the waveguides, which are typically air-filled, and the ferrite element. When a magnetizing field is created in this ferrite element, a gyromagnetic effect is produced that can be used for circulating a microwave signal from one waveguide arm to another. By reversing the direction of the magnetizing field, the direction of circulation between the waveguide arms is reversed. These waveguide circulators can be connected in various configurations to produce waveguide switching networks.

Conventional waveguide circulator switching networks that include multiple ferrite elements typically have impedance-matching transitions and an air-filled waveguide section between the ferrite elements. For example, standard waveguide circulators may transition from one ferrite element to a one-quarter wavelength dielectric transformer, to an air-filled waveguide section, and then to another one-quarter wavelength dielectric transformer, and the next ferrite element. The dielectric transformers are typically used to match the lower impedance of the ferrite element to that of the air-filled waveguide.

The air-filled waveguide section between dielectric transformers is sufficiently long, generally at least a quarter-wavelength, to allow the fields to transition back to the standard waveguide mode between circulators. Thus, the conventional transition between ferrite elements occurs over a length of three-quarters of a wavelength or greater between adjacent ferrite elements. This sets the minimum separation distance that can be obtained in multi-junction assemblies when input/output ports of multiple circulators are intercoupled to provide a more complex microwave switching or isolation arrangement. This can result in a multi-junction waveguide structure that is undesirably large and heavy. Furthermore, the insertion loss of a multiple circulator assembly increases as the separation distance between ferrite elements is increased as a result of the finite conductivity of the waveguide structure.

SUMMARY

A multi-junction circulator assembly comprises a waveguide housing including a first set of waveguide arms, a second set of waveguide arms, and a junction section between the first and second sets of waveguide arms. A first circulator component is located in the waveguide housing adjacent to the first set of waveguide arms. The first circulator component comprises a first ferrite element that includes a plurality of leg segments that each terminate at a distal end, with one of the leg segments extending toward the junction section of the waveguide housing, and the other leg segments each respectively extending toward one of the waveguide arms in the first set of waveguide arms. A second circulator component is located in the waveguide housing adjacent to the second set of waveguide arms and operatively communicates with the first circulator component. The second circulator component comprises a second ferrite element that includes a plurality of leg segments that each terminate at a distal end, with one of the leg segments of the second ferrite element extending toward the junction section of the waveguide housing, and the other leg segments of the second ferrite element each respectively extending toward one of the waveguide arms in the second set of waveguide arms. A dielectric transition segment is located in the junction section of the waveguide housing between the leg segments of the first and second ferrite elements that extend toward the junction section. The dielectric transition segment is separated from the leg segments of the first and second ferrite elements by opposing gaps at opposite ends of the dielectric transition segment. The gaps provide dielectric-free regions in the direction of signal flow between the first and second ferrite elements.

BRIEF DESCRIPTION OF THE DRAWINGS

Understanding that the drawings depict only exemplary embodiments and are not therefore to be considered limiting in scope, the exemplary embodiments will be described with additional specificity and detail through the use of the accompanying drawings, in which.

DETAILED DESCRIPTION

Figure 1A:
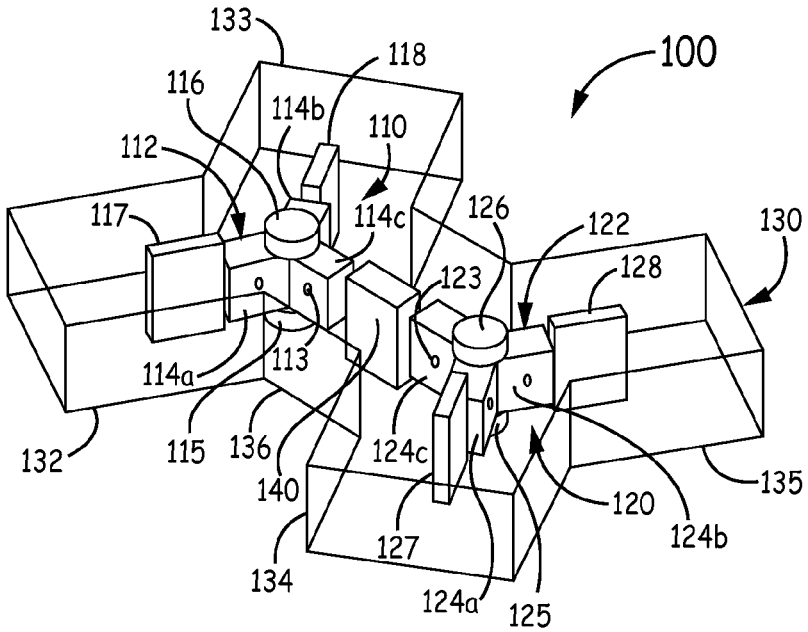
FIG. 1A is a perspective view of a multi-junction waveguide circulator assembly according to one embodiment.

In the following detailed description, embodiments are described in sufficient detail to enable those skilled in the art to practice the invention. It is to be understood that other embodiments may be utilized without departing from the scope of the invention. The following detailed description is, therefore, not to be taken in a limiting sense.

A multi-junction circulator assembly is provided that includes a waveguide housing having an internal cavity, and at least two ferrite circulators disposed in the internal cavity, with at least one shared discontinuous dielectric transformer located between the ferrite circulators in a transition section. The circulator assembly provides improved radio frequency (RF) performance in the transition section by improving dielectric impedance matching with low insertion loss over a broad frequency bandwidth. The circulator assembly mechanically isolates the two ferrite circulators in the transition section by alternating dielectric loaded and unloaded waveguide sections along the direction of RF flow.

In one embodiment, a single dielectric transformer element such as a dielectric transition segment is located in a junction section of the waveguide housing between leg segments of opposing ferrite elements that extend toward the junction section. The dielectric transition segment is separated from the each of the leg segments of the ferrite elements by opposing gaps that provide dielectric-free regions in the direction of signal flow between the ferrite elements. The ferrite elements are separated from each other by less than about one-half wavelength.

In another embodiment, additional dielectric transformer elements are employed, such as shorter dielectric transition pieces attached to the ends of the ferrite element leg segments that extend toward the junction section, with a longer dielectric transition segment located between and separate from the dielectric transition pieces. This forms a short dielectric/short air gap/long dielectric/short air gap/short dielectric pattern in the junction section, which can be offset or centered with respect to a waveguide width.

For example, the dielectric transition segment and pieces in the junction section can be slightly off-center with respect to the width of a waveguide. The dielectric transition pieces attached to the ends of the ferrite element leg segments are aligned to one edge of the width of the leg segments, and the dielectric transition segment is centered to the width of the offset dielectric transition pieces and not to the width of the waveguide. Alternatively, the dielectric transition segment and pieces in the junction section can be centered with respect to the width of the waveguide and the ferrite element leg segments.

In other embodiments, the alignment of the dielectric transition elements can be varied. For example, the shorter dielectric transition pieces attached to the ferrite element leg segments can be off-center, while the longer dielectric transition segment is centered, or vice versa, or any other combination of alignments along the width of the waveguide can be implemented.

In a further embodiment, the longer dielectric transition segment can be connected to one of the shorter dielectric transition pieces, such as by bonding, or can be manufactured as a single part having both the shorter and longer dielectric features.

In other embodiments, the waveguide features can be modified in the transition region to aid with impedance matching of the ferrite circulators, such as by reducing or increasing the width of the waveguide in the junction section between the ferrite elements.

In a method of manufacturing the circulator assembly according to one approach, a quarter-wave dielectric transition piece is attached to each end of the legs of two opposing ferrite elements, with the dielectric transition pieces rotated so that the short dimension is in the direction of RF flow (propagation) and the long dimension is along the waveguide width. A dielectric transition segment, which is doubled in width compared with the dielectric transition pieces, is positioned with its long dimension along the direction of RF flow between the two ferrite elements. The length, width, and alignment of the transition dielectric elements can be empirically adjusted to minimize the insertion loss associated with the mismatch between the two ferrite elements.

The circulator assembly can be employed in various switching configurations. For example, multiple circulator assemblies can be interconnected in a redundant switching network, such as a low noise amplifier (LNA) switching network for space applications. One such switching network employs rings of ferrite switches that are separated by between about one-quarter and about one-half of a wavelength in interconnected waveguide channels. Consequently, traditional one-quarter wavelength transformers cannot be used to transition from one ferrite switch ring to another ferrite switch ring in such a switching network.

Various embodiments of the multi-junction ferrite circulators are described hereafter with reference to the drawings.

Figure 1B:
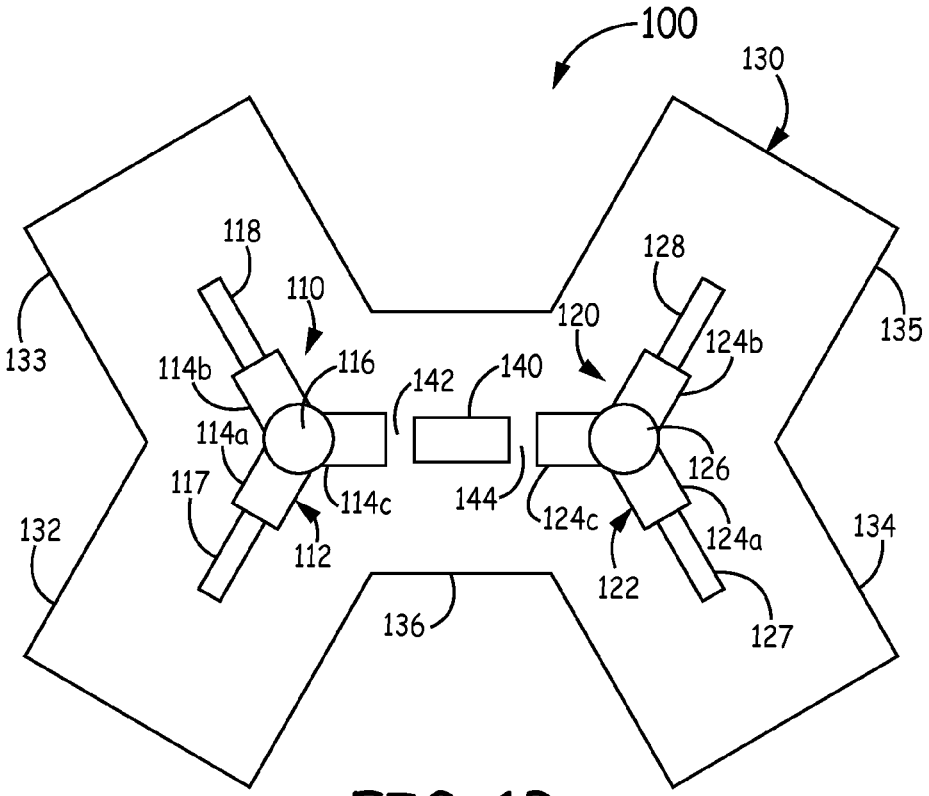
FIG. 1B is a top view of the multi-junction waveguide circulator assembly of FIG. 1A.

FIGS. 1A and 1B illustrate a multi-junction waveguide circulator assembly 100 according to one embodiment. The waveguide circulator assembly 100 generally includes a first ferrite circulator component 110 and a second ferrite circulator component 120, which are both located within an electrically conductive waveguide housing 130. While waveguide housing 130 is depicted as transparent to show the circulator components 110 and 120, it should be understood that waveguide housing 130 can be composed of a metallic material, such as aluminum, a silver-plated metal, a gold-plated metal, or the like.

The circulator component 110 includes a first ferrite element 112 that has a plurality of leg segments 114*a*, 114*b*, and 114*c*. A first dielectric spacer 115 is located on a lower surface of ferrite element 112, and a second dielectric spacer 116 is located on an upper surface of ferrite element 112. A first set of dielectric transformers 117 and 118 are respectively attached to a central location of each distal end of leg segments 114*a* and 114*b*. Likewise, circulator component 120 includes a second ferrite element 122 with a plurality of leg segments 124*a*, 124*b*, and 124*c*. A first dielectric spacer 125 is located on a lower surface of ferrite element 122, and a second dielectric spacer 126 is located on an upper surface of ferrite element 122. A second set of dielectric transformers 127 and 128 are respectively attached to a central location of each distal end of leg segments 124*a* and 124*b*.

The waveguide housing 130 has a first set of hollow waveguide arms 132, 133 and a second set of hollow waveguide arms 134, 135. The dielectric transformers 117 and 118 respectively protrude into waveguide arms 132 and 133, and dielectric transformers 127 and 128 respectively protrude into waveguide arms 134 and 135. In addition, waveguide housing 130 has a hollow junction section 136 between the waveguide arms.

The dielectric spacers securely position ferrite elements 112 and 122 in waveguide housing 130 and can provide for thermal paths out of ferrite elements 112 and 122. Exemplary materials for the dielectric spacers include boron nitride, beryllium oxide, forsterite, or cordierite.

The dielectric transformers 117 and 118 respectively aid in the transition of microwave energy from ferrite element 112 to waveguide arms 132 and 133, which can be air-filled. Similarly, dielectric transformers 127 and 128 aid in the transition of microwave energy from ferrite element 122 to waveguide arms 134 and 135. The dielectric transformers can match the lower impedance of the ferrite elements to that of the waveguide arms to reduce signal loss. Exemplary materials for the dielectric transformers include boron nitride, aluminum nitride, beryllium oxide, as well as ceramics such as forsterite or cordierite. The dielectric transformers can have a length of about one-quarter wavelength, for example.

The leg segment 114*c* of ferrite element 112 and leg segment 124*c* of ferrite element 122 face each other and protrude toward junction section 136. A dielectric transition segment 140 is interposed between leg segment 114*c* and leg segment 124*c* in junction section 136 of waveguide housing 130. The dielectric transition segment 140 is located in junction section 136 so that there is a gap 142 between one end of dielectric transition segment 140 and leg segment 114*c*, and a gap 144 between an opposite end of dielectric transition segment 140 and leg segment 124*c*. The gaps 142 and 144 provide unloaded (dielectric-free) regions in the direction of RF flow between ferrite elements 112 and 122. Exemplary materials for dielectric transition segment 140 include those described above for the dielectric transformers, such as cordierite, fosterite, or boron nitrides.

In general, the waveguide arms convey microwave energy into and out of circulator assembly 100 through the ferrite elements. For example, one or more of the waveguide arms can function as input arms while one or more other waveguide arms can function as output arms, such that a microwave signal propagates into and out of circulator assembly 100.

A control wire such as a magnetizing winding can be threaded through respective channels 113 and 123 (FIG. 1A) in the leg segments of ferrite elements 112 and 122 to make the ferrite elements switchable. When a current pulse is applied to the control wire, the ferrite elements are latched into a certain magnetization. By switching the polarity of the current pulse applied to the control wire, the signal flow direction in circulator 100 can be switched from one waveguide arm to another waveguide arm as needed.

Figure 2A:
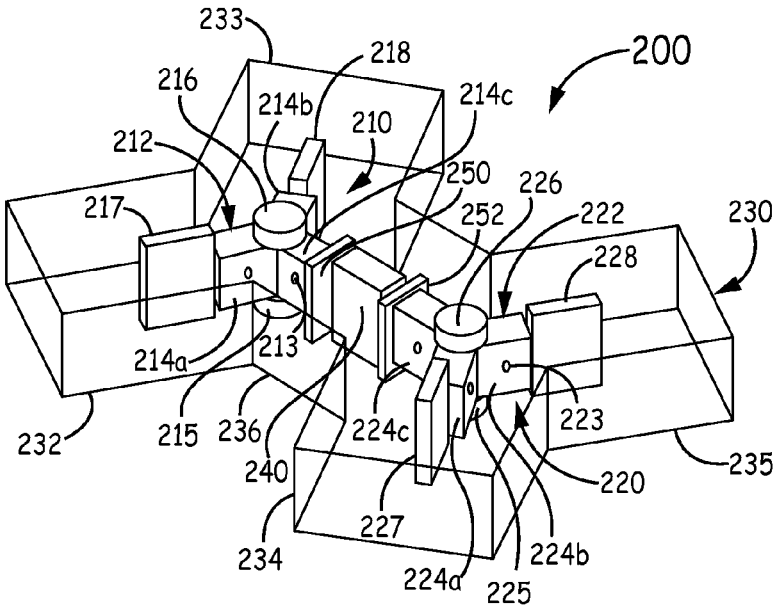
FIG. 2A is a perspective view of a multi-junction waveguide circulator assembly according to another embodiment.
Figure 2B:
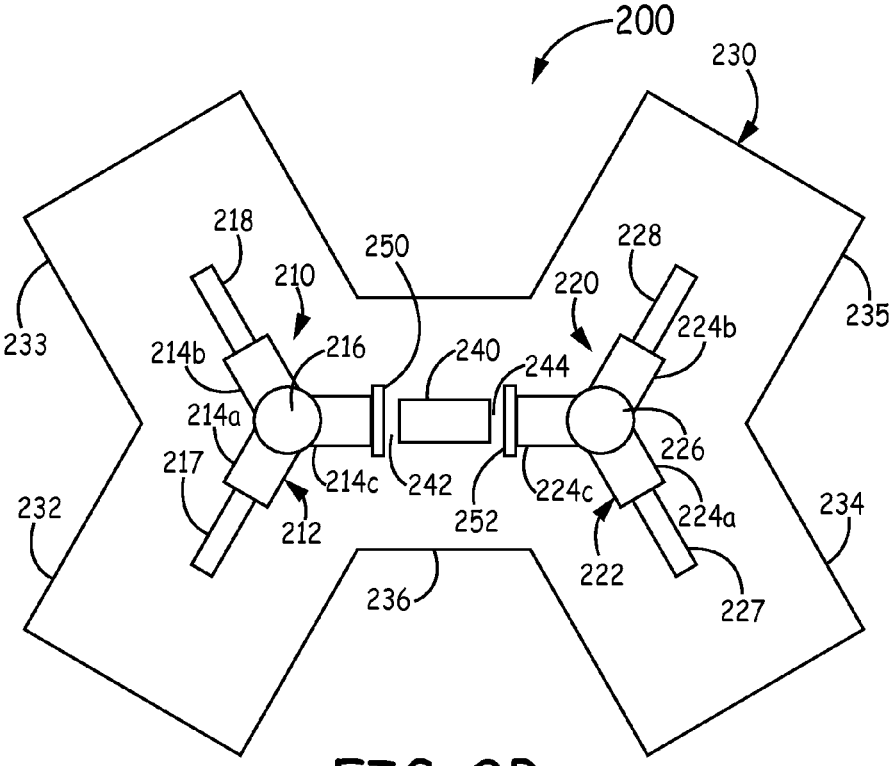
FIG. 2B is a top view of the multi-junction waveguide circulator assembly of FIG. 2A.

FIGS. 2A and 2B illustrate a multi-junction waveguide circulator assembly 200 according to another embodiment. The waveguide circulator assembly 200 includes similar components as discussed above for waveguide circulator assembly 100, with some additional variations.

Accordingly, waveguide circulator assembly 200 generally includes a first ferrite circulator component 210 and a second ferrite circulator component 220, which are both located within an electrically conductive waveguide housing 230. The circulator component 210 includes a first ferrite element 212 that has a plurality of leg segments 214*a*, 214*b*, and 214*c*. A first dielectric spacer 215 is located on a lower surface of ferrite element 212, and a second dielectric spacer 216 is located on an upper surface of ferrite element 212. Although dielectric spacers are often included for alignment, structural support, or thermal conductivity purposes, it is understood that the spacers may not be necessary in certain applications, as is understood by those skilled in the art. A first set of dielectric transformers 217 and 218 are respectively attached to a central location of each distal end of leg segments 214*a* and 214*b*.

Likewise, circulator component 220 includes a second ferrite element 222 with a plurality of leg segments 224*a*, 224*b*, and 224*c*. A first dielectric spacer 225 is located on a lower surface of ferrite element 222, and a second dielectric spacer 226 is located on an upper surface of ferrite element 222. A second set of dielectric transformers 227 and 228 are respectively attached to a central location of each distal end of leg segments 224*a* and 224*b*.

The waveguide housing 230 has a first set of hollow waveguide arms 232, 233 and a second set of hollow waveguide arms 234, 235. The dielectric transformers 217 and 218 respectively protrude into waveguide arms 232 and 233, while dielectric transformers 227 and 228 respectively protrude into waveguide arms 234 and 235. In addition, waveguide housing 230 has a junction section 236 between the waveguide arms.

The leg segment 214*c* of ferrite element 212 and leg segment 224*c* of ferrite element 222 face each other and protrude toward junction section 236. A dielectric transition segment 240 is interposed between leg segment 214*c* and leg segment 224*c* in junction section 236 of waveguide housing 230. The dielectric transition segment 240 is located in junction section 236 so that there is a gap 242 between one end of dielectric transition segment 240 and leg segment 214*c*, and a gap 244 between an opposite end of dielectric transition segment 240 and leg segment 224*c*.

In addition, a first dielectric transition piece 250 is attached to the distal end of leg segment 214*c* such that dielectric transition piece 250 faces one end of dielectric transition segment 240 and is separated from dielectric transition segment 240 by gap 242. A second dielectric transition piece 252 is attached to the distal end of leg segment 224*c* such that dielectric transition piece 252 faces an opposite end of dielectric transition segment 240 and is separated from dielectric transition segment 240 by gap 244. As shown in FIGS. 2A and 2B, dielectric transition segment 240 and dielectric transition pieces 252, 254 are positioned to be centrally aligned with leg segment 214*c* of ferrite element 212 and leg segment 224*c* of ferrite element 222. The dielectric transition pieces 252, 254 provide additional features for tuning the desired performance of the circulator components, and also provide additional structural support to the ferrite elements. Although not shown, empirical matching elements may also be disposed on the surface of the conductive waveguide housing 230 to further affect the performance.

A control wire such as a magnetizing winding can be threaded through respective channels 213 and 223 (FIG. 2A) in the leg segments of ferrite elements 212 and 222 to make the ferrite elements switchable.

Figure 3A:
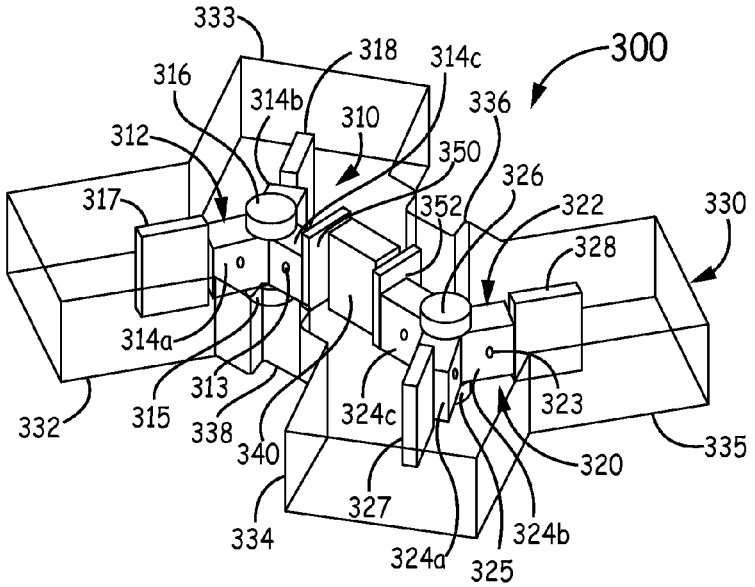
FIG. 3A is a perspective view of a multi-junction waveguide circulator assembly according to a further embodiment.
Figure 3B:
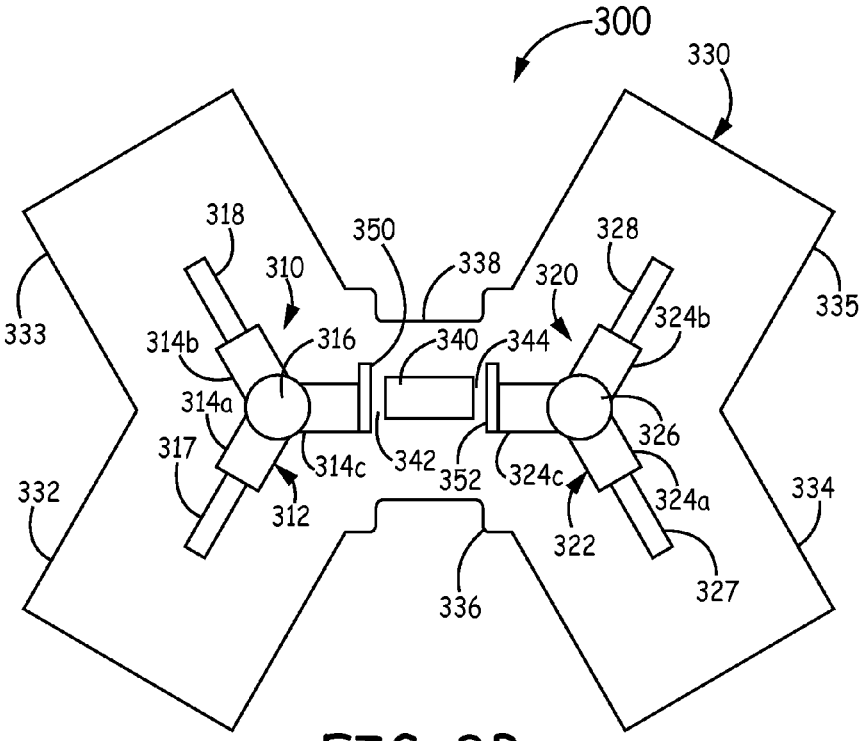
FIG. 3B is a top view of the multi-junction waveguide circulator assembly of FIG. 3A.

FIGS. 3A and 3B illustrate a multi-junction waveguide circulator assembly 300 according to another embodiment. The waveguide circulator assembly 300 includes similar components as discussed above for waveguide circulator assembly 200, with some additional variations.

Accordingly, waveguide circulator assembly 300 generally includes a first ferrite circulator component 310 and a second ferrite circulator component 320, which are both located within an electrically conductive waveguide housing 330. The circulator component 310 includes a first ferrite element 312 that has a plurality of leg segments 314*a*, 314*b*, and 314*c*. A first dielectric spacer 315 is located on a lower surface of ferrite element 312, and a second dielectric spacer 316 is located on an upper surface of ferrite element 312. A first set of dielectric transformers 317 and 318 are respectively attached to a central location of each distal end of leg segments 314*a* and 314*b*.

Likewise, circulator component 320 includes a second ferrite element 322 with a plurality of leg segments 324*a*, 324*b*, and 324*c*. A first dielectric spacer 325 is located on a lower surface of ferrite element 322, and a second dielectric spacer 326 is located on an upper surface of ferrite element 322. A second set of dielectric transformers 327 and 328 are respectively attached to a central location of each distal end of leg segments 324*a* and 324*b*. The waveguide housing 330 has a first set of hollow waveguide arms 332, 333 and a second set of hollow waveguide arms 334, 335. The dielectric transformers 317 and 318 respectively protrude into waveguide arms 332 and 333, while dielectric transformers 327 and 328 respectively protrude into waveguide arms 334 and 335. In addition, waveguide housing 330 has a junction section 336 between the waveguide arms, with junction section 336 having a narrowed neck portion 338.

The leg segment 314*c* of ferrite element 312 and leg segment 324*c* of ferrite element 322 face each other and protrude toward junction section 336. A dielectric transition segment 340 is interposed between leg segment 314*c* and leg segment 324*c* in junction section 336 of waveguide housing 330. The dielectric transition segment 340 is located in narrowed neck portion 338 of junction section 336 so that there is a gap 342 between one end of dielectric transition segment 340 and leg segment 314*c*, and a gap 344 between an opposite end of dielectric transition segment 340 and leg segment 324*c*.

In addition, a first dielectric transition piece 350 is attached to the distal end of leg segment 314*c* such that dielectric transition piece 350 faces one end of dielectric transition segment 340 and is separated from dielectric transition segment 340 by gap 342. A second dielectric transition piece 352 is attached to the distal end of leg segment 324*c* such that dielectric transition piece 352 faces an opposite end of dielectric transition segment 340 and is separated from dielectric transition segment 340 by gap 344. As shown in FIGS. 3A and 3B, dielectric transition segment 340 and dielectric transition pieces 352, 354 are positioned to have an off-center alignment with leg segment 314*c* of ferrite element 312 and leg segment 324*c* of ferrite element 322.

A control wire such as a magnetizing winding can be threaded through respective channels 313 and 323 (FIG. 3A) in the leg segments of ferrite elements 312 and 322 to make the ferrite elements switchable.

Figure 4:
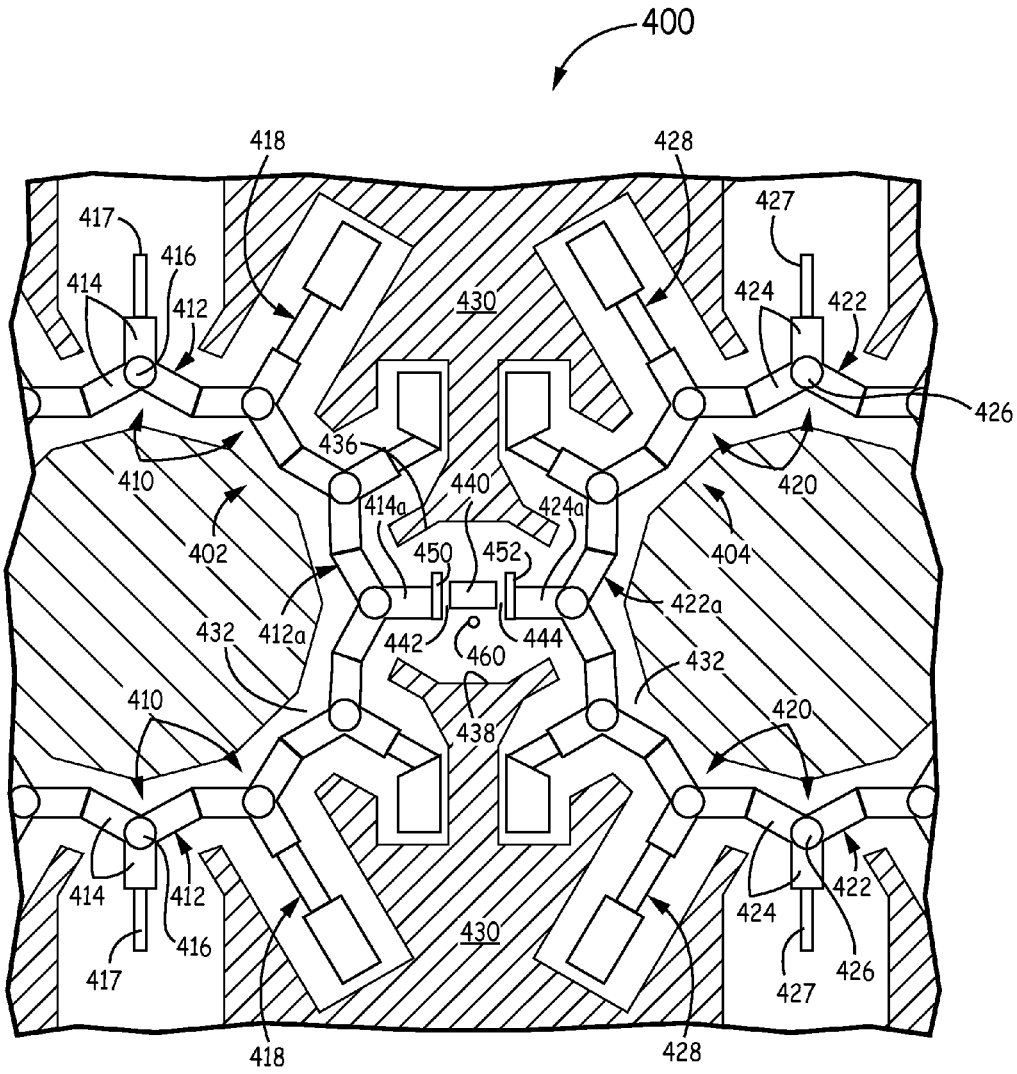
FIG. 4 is a top sectional view of a portion of a switching redundancy network that implements multi-junction waveguide circulators according to one embodiment.

FIG. 4 illustrates a section of a switching redundancy network 400 that implements multi-junction waveguide circulators according to one embodiment. The redundancy network 400 includes a first circulator switch ring 402 that includes multiple circulator components 410, and at least a second circulator switch ring 404 that includes multiple circulator components 420. An electrically conductive waveguide housing 430 defines a plurality of interconnected channels 432 that contain circulator components 410 and 420.

The circulator components 410 each include a ferrite element 412 with a plurality of leg segments 414, and at least one dielectric spacer 416 located on a surface of ferrite element 412. Likewise, circulator components 420 each include a ferrite element 422 with a plurality of leg segments 424, and at least one dielectric spacer 426 located on a surface of ferrite element 422.

The ferrite elements 412 are configured in a ring structure such that two of the three leg segments 414 in each ferrite element face adjacent leg segments in neighboring ferrite elements. The other leg segments in ferrite elements 412 are attached to a dielectric transformer 417, or to a matched load section 418 that terminates sections of the waveguide to isolate signals that may propagate in a wrong direction. Similarly, ferrite elements 422 are configured in a ring structure such that two of the three leg segments 424 in each ferrite element face adjacent leg segments in neighboring ferrite elements. The other leg segments in ferrite elements 422 are attached to a dielectric transformer 427, or to a matched load section 428 that terminates sections of the waveguide.

A magnetizing winding can be threaded through channels in each of the leg segments of ferrite elements 412. Likewise, a magnetizing winding can be threaded through channels in each of the leg segments of ferrite elements 422. The magnetizing windings allow for switching the direction of propagation or RF flow within waveguide housing 430.

The switch ring 402 is operatively coupled to the switch ring 404 through a junction section 436 of waveguide housing 430. A leg segment 414*a* of a ferrite element 412*a* and a leg segment 424*a* of a ferrite element 422*a* face each other and protrude into junction section 436. A dielectric transition segment 440 is interposed between leg segment 414*a* and leg segment 424*a* in junction section 436. The dielectric transition segment 440 is located in an expanded neck portion 438 of junction section 436 so that there is a gap 442 between one end of dielectric transition segment 440 and leg segment 414*a*, and a gap 444 between an opposite end of dielectric transition segment 440 and leg segment 424*a*. A first dielectric transition piece 450 is attached to the distal end of leg segment 414*a* such that dielectric transition piece 450 faces one end of dielectric transition segment 440 and is separated from dielectric transition segment 440 by gap 442. A second dielectric transition piece 452 is attached to the distal end of leg segment 424*a* such that dielectric transition piece 452 faces an opposite end of dielectric transition segment 440 and is separated from dielectric transition segment 440 by gap 444.

The configuration of dielectric transition segment 440 and dielectric transition pieces 450, 452 provide three dielectric matching elements that form a pattern comprising a short dielectric/short air gap/long dielectric/short air gap/short dielectric. This configuration of dielectric transition segment 440 and dielectric transition pieces 450, 452 reduce the impedance mismatch loss between switch rings 402 and 404.

The two short dielectric transition pieces attached to the ferrite elements are electrically short in the direction of propagation or RF flow. In one embodiment, the long dielectric segment has a length of about one-quarter wavelength, and the short dielectric transition pieces each have a length of less than about one-eighth wavelength. The short dielectric transition pieces not only provide an additional feature to tune the desired performance, but also provide some structural support to the ferrite elements.

One or more optional empirical matching elements may be disposed on the surface of waveguide housing 430 to affect performance. The matching elements can be capacitive/inductive dielectric or metallic buttons that are used to empirically improve the impedance match over the desired operating frequency band. In one embodiment, an empirical matching element 460 can be disposed near dielectric transition segment 440 and may account for material or dimensional variations in dielectric transition segment 440. Similar matching elements may be located adjacent to other dielectric transition elements for similar purposes.

As shown in FIG. 4, dielectric transition segment 440 and dielectric transition pieces 450, 452 are positioned to have an off-center alignment with leg segment 414*a* and leg segment 424*a*. In an alternative embodiment, dielectric transition segment 440 and dielectric transition pieces 450, 452 can be positioned to be centrally aligned with leg segment 414*a* and leg segment 424*a*, similar to the embodiment shown in FIGS. 2A and 2B. In another alternative embodiment, dielectric transition segment 440 can be used without dielectric transition pieces 450, 452, similar to the embodiment shown in FIGS. 1A and 1B.

EXAMPLE EMBODIMENTS

Example 1 includes a multi-junction circulator assembly comprising: a waveguide housing including a first set of waveguide arms, a second set of waveguide arms, and a junction section between the first and second sets of waveguide arms; a first circulator component located in the waveguide housing adjacent to the first set of waveguide arms, the first circulator component comprising a first ferrite element that includes a plurality of leg segments that each terminate at a distal end, wherein one of the leg segments extends toward the junction section of the waveguide housing, and the other leg segments each respectively extend toward one of the waveguide arms in the first set of waveguide arms; a second circulator component located in the waveguide housing adjacent to the second set of waveguide arms, wherein the second circulator component operatively communicates with the first circulator component, the second circulator component comprising a second ferrite element that includes a plurality of leg segments that each terminate at a distal end, wherein one of the leg segments of the second ferrite element extends toward the junction section of the waveguide housing, and the other leg segments of the second ferrite element each respectively extend toward one of the waveguide arms in the second set of waveguide arms; and a dielectric transition segment located in the junction section of the waveguide housing between the leg segments of the first and second ferrite elements that extend toward the junction section, the dielectric transition segment separated from the leg segments of the first and second ferrite elements by opposing gaps at opposite ends of the dielectric transition segment; wherein the gaps provide dielectric-free regions in the direction of signal flow between the first and second ferrite elements.

Example 2 includes the circulator assembly of Example 1, further comprising a first set of dielectric transformers each respectively attached to the distal end of one of the leg segments of the first ferrite element that extend toward the first set of waveguide arms, the first set of dielectric transformers each respectively protruding into one of the waveguide arms in the first set of waveguide arms.

Example 3 includes the circulator assembly of Example 2, further comprising a second set of dielectric transformers each respectively attached to the distal end of one of the leg segments of the second ferrite element that extend toward the second set of waveguide arms, the second set of dielectric transformers each respectively protruding into one of the waveguide arms in the second set of waveguide arms.

Example 4 includes the circulator assembly of any of Examples 1-3, further comprising a first dielectric spacer located on a lower surface of the first ferrite element, and a second dielectric spacer located on an upper surface of the first ferrite element; and a first dielectric spacer located on a lower surface of the second ferrite element, and a second dielectric spacer located on an upper surface of the second ferrite element.

Example 5 includes the circulator assembly of any of Examples 1-4, wherein the first and second ferrite elements are separated from each other by less than about one-half wavelength.

Example 6 includes the circulator assembly of any of Examples 1-5, further comprising a first dielectric transition piece attached to the distal end of the leg segment of the first ferrite element that extends toward the junction section of the waveguide housing, the first dielectric transition piece separated from one end of the dielectric transition segment by one of the gaps.

Example 7 includes the circulator assembly of Example 6, further comprising a second dielectric transition piece attached to the distal end of the leg segment of the second ferrite element that extends toward the junction section of the waveguide housing, the second dielectric transition piece separated from an opposite end of the dielectric transition segment by the other of the gaps.

Example 8 includes the circulator assembly of Example 7, wherein the dielectric transition segment and the dielectric transition pieces are positioned in the junction section to be centrally aligned with the leg segments of the first and second ferrite elements that extend toward the junction section.

Example 9 includes the circulator assembly of Example 7, wherein the dielectric transition segment and the dielectric transition pieces are positioned in the junction section to have an off-center alignment with the leg segments of the first and second ferrite elements that extend toward the junction section.

Example 10 includes the circulator assembly of any of Examples 1-9, wherein the junction section has a narrowed neck portion.

Example 11 includes the circulator assembly of any of Examples 1-9, wherein the junction section has an expanded neck portion.

Example 12 includes the circulator assembly of any of Examples 7-11, wherein the dielectric transition segment has a length of about one-quarter wavelength, and the dielectric transition pieces each have a length of less than about one-eighth wavelength.

Example 13 includes the circulator assembly of any of Examples 1-12, wherein the leg segments of the first and second ferrite elements have channels for threading control wires therethrough.

Example 14 includes the circulator assembly of any of Examples 1-13, wherein the first circulator component operatively communicates with the second circulator component as part of a switching redundancy network.

Example 15 includes a switching redundancy network comprising a waveguide housing including at least one junction section; a first switch ring in the waveguide housing, the first switch ring including a first set of circulator components that operatively communicate with each other, wherein the first set of circulator components each comprise a ferrite element that includes a plurality of leg segments; at least a second switch ring in the waveguide housing, the second switch ring including a second set of circulator components that operatively communicate with each other, wherein the second set of circulator components each comprise a ferrite element that includes a plurality of leg segments; wherein the first switch ring is operatively coupled to the second switch ring through communication between a first circulator component in the first switch ring and a second circulator component in the second switch ring; wherein one of the leg segments of the ferrite element in the first circulator component extends into the junction section of the waveguide housing, and one of the leg segments of the ferrite element in the second circulator component extends into the junction section; a dielectric transition segment located in the junction section between the leg segments of the ferrite elements that extend into the junction section, the dielectric transition segment separated from the leg segments by opposing gaps at opposite ends of the dielectric transition segment; wherein the gaps provide dielectric-free regions in the direction of signal flow between the first and second circulator components to reduce impedance mismatch loss between the first and second switch rings.

Example 16 includes the switching redundancy network of Example 15, further comprising a first dielectric transition piece attached to a distal end of the leg segment of the ferrite element in the first circulator component that extends into the junction section, the first dielectric transition piece facing one end of the dielectric transition segment across from one of the gaps.

Example 17 includes the switching redundancy network of Example 16, further comprising a second dielectric transition piece attached to a distal end of the leg segment of the ferrite element in the second circulator component that extends into the junction section, the second dielectric transition piece facing an opposite end of the dielectric segment across from the other of the gaps.

Example 18 includes the switching redundancy network of Example 17, wherein the dielectric transition segment and the dielectric transition pieces are positioned in the junction section to be centrally aligned with the leg segments of the ferrite elements that extend into the junction section.

Example 19 includes the switching redundancy network of Example 17, wherein the dielectric transition segment and the dielectric transition pieces are positioned in the junction section to have an off-center alignment with the leg segments of the ferrite elements that extend into the junction section.

Example 20 includes the switching redundancy network of any of Examples 15-19, further comprising at least one empirical matching element disposed adjacent to the dielectric transition segment.

The present invention may be embodied in other forms without departing from its essential characteristics. The described embodiments are to be considered in all respects only as illustrative and not restrictive. Therefore, it is intended that this invention be limited only by the claims and the equivalents thereof.

What is claimed is:

1. A multi-junction circulator assembly, comprising:

a waveguide housing including a first set of waveguide arms, a second set of waveguide arms, and a junction section between the first and second sets of waveguide arms;

a first circulator component located in the waveguide housing adjacent to the first set of waveguide arms, the first circulator component comprising:

a first ferrite element that includes a plurality of leg segments that each terminate at a distal end, wherein one of the leg segments extends toward the junction section of the waveguide housing, and the other leg segments each respectively extend toward one of the waveguide arms in the first set of waveguide arms;

a second circulator component located in the waveguide housing adjacent to the second set of waveguide arms, wherein the second circulator component operatively communicates with the first circulator component, the second circulator component comprising:

a second ferrite element that includes a plurality of leg segments that each terminate at a distal end, wherein one of the leg segments of the second ferrite element extends toward the junction section of the waveguide housing, and the other leg segments of the second ferrite element each respectively extend toward one of the waveguide arms in the second set of waveguide arms; and a dielectric transition segment located in the junction section of the waveguide housing between the leg segments of the first and second ferrite elements that extend toward the junction section, the dielectric transition segment separated from the leg segments of the first and second ferrite elements by opposing gaps at opposite ends of the dielectric transition segment;

wherein the gaps provide dielectric-free regions in the direction of signal flow between the first and second ferrite elements.

2. The circulator assembly of claim 1, further comprising:

a first dielectric spacer located on a lower surface of the first ferrite element, and a second dielectric spacer located on an upper surface of the first ferrite element; and a first dielectric spacer located on a lower surface of the second ferrite element, and a second dielectric spacer located on an upper surface of the second ferrite element.

3. The circulator assembly of claim 1, wherein the first and second ferrite elements are separated from each other by less than about one-half wavelength.

4. The circulator assembly of claim 1, wherein the leg segments of the first and second ferrite elements have channels for threading control wires therethrough.

5. The circulator assembly of claim 1, wherein the first circulator component operatively communicates with the second circulator component as part of a switching redundancy network.

6. The circulator assembly of claim 1, further comprising a first set of dielectric transformers each respectively attached to the distal end of one of the leg segments of the first ferrite element that extend toward the first set of waveguide arms, the first set of dielectric transformers each respectively protruding into one of the waveguide arms in the first set of waveguide arms.

7. The circulator assembly of claim 6, further comprising a second set of dielectric transformers each respectively attached to the distal end of one of the leg segments of the second ferrite element that extend toward the second set of waveguide arms, the second set of dielectric transformers each respectively protruding into one of the waveguide arms in the second set of waveguide arms.

8. The circulator assembly of claim 1, further comprising a first dielectric transition piece attached to the distal end of the leg segment of the first ferrite element that extends toward the junction section of the waveguide housing, the first dielectric transition piece separated from one end of the dielectric transition segment by one of the gaps.

9. The circulator assembly of claim 8, further comprising a second dielectric transition piece attached to the distal end of the leg segment of the second ferrite element that extends toward the junction section of the waveguide housing, the second dielectric transition piece separated from an opposite end of the dielectric transition segment by the other of the gaps.

10. The circulator assembly of claim 9, wherein the dielectric transition segment and the dielectric transition pieces are positioned in the junction section to be centrally aligned with the leg segments of the first and second ferrite elements that extend toward the junction section.

11. The circulator assembly of claim 9, wherein the dielectric transition segment and the dielectric transition pieces are positioned in the junction section to have an off-center alignment with the leg segments of the first and second ferrite elements that extend toward the junction section.

12. The circulator assembly of claim 9, wherein the junction section has a narrowed neck portion.

13. The circulator assembly of claim 9, wherein the junction section has an expanded neck portion.

14. The circulator assembly of claim 9, wherein the dielectric transition segment has a length of about one-quarter wavelength, and the dielectric transition pieces each have a length of less than about one-eighth wavelength.

15. A switching redundancy network, comprising:

a waveguide housing including at least one junction section;

a first switch ring in the waveguide housing, the first switch ring including a first set of circulator components that operatively communicate with each other, wherein the first set of circulator components each comprise a ferrite element that includes a plurality of leg segments;

at least a second switch ring in the waveguide housing, the second switch ring including a second set of circulator components that operatively communicate with each other, wherein the second set of circulator components each comprise a ferrite element that includes a plurality of leg segments;

wherein the first switch ring is operatively coupled to the second switch ring through communication between a first circulator component in the first switch ring and a second circulator component in the second switch ring;

wherein one of the leg segments of the ferrite element in the first circulator component extends into the junction section of the waveguide housing, and one of the leg segments of the ferrite element in the second circulator component extends into the junction section;

a dielectric transition segment located in the junction section between the leg segments of the ferrite elements that extend into the junction section, the dielectric transition segment separated from the leg segments by opposing gaps at opposite ends of the dielectric transition segment;

wherein the gaps provide dielectric-free regions in the direction of signal flow between the first and second circulator components to reduce impedance mismatch loss between the first and second switch rings.

16. The switching redundancy network of claim 15, further comprising at least one empirical matching element disposed adjacent to the dielectric transition segment.

17. The switching redundancy network of claim 15, further comprising a first dielectric transition piece attached to a distal end of the leg segment of the ferrite element in the first circulator component that extends into the junction section, the first dielectric transition piece facing one end of the dielectric transition segment across from one of the gaps.

18. The switching redundancy network of claim 17, further comprising a second dielectric transition piece attached to a distal end of the leg segment of the ferrite element in the second circulator component that extends into the junction section, the second dielectric transition piece facing an opposite end of the dielectric segment across from the other of the gaps.

19. The switching redundancy network of claim 18, wherein the dielectric transition segment and the dielectric transition pieces are positioned in the junction section to be centrally aligned with the leg segments of the ferrite elements that extend into the junction section.

20. The switching redundancy network of claim 18, wherein the dielectric transition segment and the dielectric transition pieces are positioned in the junction section to have an off-center alignment with the leg segments of the ferrite elements that extend into the junction section.

* * * * *